US011174533B2

(12) United States Patent
Guo et al.

(10) Patent No.: US 11,174,533 B2
(45) Date of Patent: Nov. 16, 2021

(54) CU-BASED MICROCRYSTAL ALLOY AND PREPARATION METHOD THEREOF

(71) Applicant: BYD COMPANY LIMITED, Shenzhen (CN)

(72) Inventors: Qiang Guo, Shenzhen (CN); Mengde Wang, Shenzhen (CN); Wei An, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 88 days.

(21) Appl. No.: 16/627,882

(22) PCT Filed: Jul. 2, 2018

(86) PCT No.: PCT/CN2018/093978

§ 371 (c)(1),
(2) Date: Dec. 31, 2019

(87) PCT Pub. No.: WO2019/007301

PCT Pub. Date: Jan. 10, 2019

(65) Prior Publication Data

US 2020/0157659 A1 May 21, 2020

(30) Foreign Application Priority Data

Jul. 3, 2017 (CN) ..... 201710530856.3

(51) Int. Cl.
*C22C 9/05* (2006.01)
*C22C 1/02* (2006.01)

(52) U.S. Cl.
CPC . *C22C 9/05* (2013.01); *C22C 1/02* (2013.01)

(58) Field of Classification Search
None
See application file for complete search history.

(56) References Cited

U.S. PATENT DOCUMENTS 5,489,417 A 2/1996 Watson et al.

FOREIGN PATENT DOCUMENTS

| | | | | |
|---|---|---|---|---|
| CN | 1930315 | A | | 3/2007 |
| CN | 102061406 | A | | 5/2011 |
| CN | 104862524 | A | | 8/2015 |
| CN | 105228953 | A | | 1/2016 |
| CN | 105408509 | A | | 3/2016 |
| CN | 105525134 | A | * | 4/2016 |
| CN | 105525134 | A | | 4/2016 |
| CN | 106148757 | A | | 11/2016 |
| CN | 106460098 | A | | 2/2017 |
| CN | 106498222 | A | | 3/2017 |
| CN | 106756796 | A | | 5/2017 |
| JP | H01309936 | A | | 12/1989 |
| JP | H05156390 | A | | 6/1993 |

OTHER PUBLICATIONS

English language machine translation of CN-105525134-A to Gong et al. Generated May 22, 2021. (Year: 2021).*
The World Intellectual Property Organization (WIPO) International Search Report for PCT/CN2018/093978 dated Sep. 12, 2018 6 Pages.

* cited by examiner

*Primary Examiner* — Brian D Walck
(74) *Attorney, Agent, or Firm* — Anova Law Group, PLLC

(57) ABSTRACT

The disclosure relates to a Cu-based microcrystal alloy and a preparation method thereof. Through being measured in percentage by mass, the Cu-based microcrystal alloy provided by the disclosure includes 20 to 30 percent of Mn, 0.01 to 10 percent of Al, 5 to 10 percent of Ni, 0.3 to 1.5 percent of Ti, 0 to 1.5 percent of Zr, 0.05 to 2 percent of Si and 45 to 74.64 percent of Cu.

13 Claims, No Drawings

CU-BASED MICROCRYSTAL ALLOY AND PREPARATION METHOD THEREOF

CROSS-REFERENCE TO RELATED APPLICATIONS

This application is a national phase entry under 35 U.S.C. § 371 of International Application No. PCT/CN2018/093978, filed on Jul. 2, 2018, which claims a priority to and benefits of Chinese Patent Application Serial No. 201710530856.3, filed with the State Intellectual Property Office of P. R. China on Jul. 3, 2017, the entire content of all of which is incorporated herein by reference.

FIELD

The disclosure relates to a Cu-based microcrystal alloy and a preparation method thereof.

BACKGROUND

An amorphous alloy is a novel alloy material. Atoms in an internal structure of the amorphous alloy are in long-range disordered and short-range ordered arrangement. In its XRD (X-ray diffraction) pattern, diffuse scattering steamed bun peaks exist, but sharp peaks do not exist. Defects such as crystal boundary and dislocation of crystal materials do not exist in the amorphous alloy, and high strength, high hardness and excellent anti-corrosion performance are shown. A Zr-based amorphous alloy has very high apparent quality due to its self-lubrication performance on the surface. Only elastic deformation occurs in a material deformation process with the performance of brittle fracture. In addition, the Zr-based amorphous alloy may be shaped in one step, and has greater design freedom. However, the Zr-based amorphous alloy has the following defects that firstly, the amorphous alloy has relatively high requirements on raw material purity in a preparation process, and in addition, raw material cost is obviously increased and the application range is greatly limited due to Zr and other rare earth elements in the amorphous alloy raw materials; secondly, the amorphous alloy does not have a crystal structure, and has no characteristics of crystal boundary, dislocation and the like, so that brittleness of the amorphous alloy is relatively great, toughness is reduced, and a fracture elongation rate is relatively small; and finally, a melting point of the amorphous alloy is relatively high, so that melting difficulty is increased.

The Cu-based microcrystal alloy has good crystallinity degree, but has a great number of nanoscale crystal grains, so that besides sharp peaks, wide and dispersed steamed bun peaks may also occur in its XRD pattern. Through occurrence of the Cu-based microcrystal alloy, the problems of great brittleness and high cost of the existing amorphous alloy are solved; additionally, original high-strength performance of the Cu-based microcrystal alloy is remained; toughness of the material is obviously improved; and product cost is obviously reduced. However, due to the existence of a crystal structure in the Cu-based microcrystal alloy, compared with the amorphous alloy, the Cu-based microcrystal alloy has lower strength and lower hardness. Additionally, due to lower yielding strength, the Cu-based microcrystal alloy has greater plastic deformation in a deformation process, and a prepared product has soft texture and easily deforms. In addition, like the amorphous alloy, the Cu-based microcrystal alloy also has a high melting point, and melting difficulty is increased.

SUMMARY

The disclosure aims at providing a Cu-based microcrystal alloy with performance between a Zr-based microcrystal alloy and an existing Cu-based microcrystal alloy and with the advantages of both the Zr-based microcrystal alloy and the existing Cu-based microcrystal alloy. The Cu-based microcrystal alloy solves the problems of raw material cost and preparation while meeting mechanical performance requirements of an alloy product. Fracture toughness of the alloy is increased, and a color and luster degree is improved.

According to a first aspect of the disclosure, the disclosure provides a Cu-based microcrystal alloy. Based on the total mass of the Cu-based microcrystal alloy as reference and through being measured in percentage by mass, the Cu-based microcrystal alloy includes the following elements:

20 to 30 percent of Mn,
0.01 to 10 percent of Al,
5 to 10 percent of Ni,
0.3 to 1.5 percent of Ti,
0 to 1.5 percent of Zr,
0.05 to 2 percent of Si, and
45 to 74.64 percent of Cu.

According to a second aspect of the disclosure, the disclosure provides a Cu-based microcrystal alloy. Based on the total mass of the Cu-based microcrystal alloy as reference and through being measured in percentage by mass, the Cu-based microcrystal alloy includes the following elements:

| | |
|---|---|
| Mn | 20 to 30 percent, |
| Al | 0.01 to 10 percent, |
| Ni | 5 to 10 percent, |
| Ti | 0.3 to 1.5 percent, |
| Zr | 0 to 1.5 percent, |
| Si | 0.05 to 2 percent, and |
| | the balance of Cu. |

According to a third aspect of the disclosure, the disclosure provides a preparation method of a Cu-based microcrystal alloy. The method includes the step of sequentially melting and casting raw materials of the Cu-based microcrystal alloy, where through the composition of the raw materials of the Cu-based microcrystal alloy, the obtained Cu-based microcrystal alloy is the Cu-based microcrystal alloy provided by the disclosure.

The Cu-based microcrystal alloy provided by the disclosure has good comprehensive mechanical performance, relatively high strength and hardness, good shaping performance, high fracture toughness and no yielding phenomenon while the raw material cost is reduced. In addition, the Cu-based microcrystal alloy has a relatively low melting point and good casting performance. Additionally, compared with ordinary Cu-based microcrystal alloy, the Cu-based microcrystal alloy has relatively bright surface and good color and luster degree, and is favorable for later stage apparent treatment of a product.

Other aspects and advantages of the present disclosure will be given in the following description, some of which will become apparent from the following description or may be learned from practices of the present disclosure.

DETAILED DESCRIPTION

The following describes embodiments of the present disclosure in detail. The embodiments described below are exemplary, and are intended to explain the present disclosure and cannot be construed as a limitation to the present disclosure.

Based on the total mass of the Cu-based microcrystal alloy as reference and through being measured in percentage by mass, the Cu-based microcrystal alloy according to the disclosure includes the following elements:

| | |
|---|---|
| Mn | 20 to 30 percent, |
| Al | 0.01 to 10 percent, |
| Ni | 5 to 10 percent, |
| Ti | 0.3 to 1.5 percent, |
| Zr | 0 to 1.5 percent, |
| Si | 0.05 to 2 percent, and |
| Cu | 45 to 74.64 percent. |

The disclosed Cu-based microcrystal alloy includes manganese (Mn). Manganese has a main effect of improving and enhancing hardness, strength, toughness and wear resistance of the alloy. Based on the total mass of the Cu-based microcrystal alloy and in terms of mass percentage, the Cu-based microcrystal alloy according to the disclosure includes 20 to 30 percent of manganese (preferably 23 to 28 percent).

The disclosed Cu-based microcrystal alloy includes aluminum (Al). Al and Cu may form an $Al_2Cu$ phase existing in most amorphous or amorphous and crystal phase alloys in an amorphous shaping process. Based on the total mass of the Cu-based microcrystal alloy and in terms of mass percentage, the Cu-based microcrystal alloy according to the disclosure includes 0.01 to 10 percent of aluminum (preferably 3 to 8 percent).

The disclosed Cu-based microcrystal alloy includes nickel (Ni). Nickel can maintain good plasticity and toughness of the alloy while improving the alloy strength, and achieves a certain improvement effect on anti-corrosion performance of the alloy. Based on the total mass of the Cu-based microcrystal alloy and in terms of mass percentage, the Cu-based microcrystal alloy according to the disclosure includes 5 to 10 percent of nickel (preferably 8 to 10 percent).

The disclosed Cu-based microcrystal alloy includes titanium (Ti). Through addition of titanium, not only are flowability and cutting performance of the alloy improved, but also crack resistance of the alloy is improved. Based on the total mass of the Cu-based microcrystal alloy and in terms of mass percentage, the Cu-based microcrystal alloy according to the disclosure includes 0.3 to 1.5 percent of titanium (preferably 0.5 to 0.8 percent).

The disclosed Cu-based microcrystal alloy includes zirconium (Zr) and silicon (Si). Through addition of zirconium, hardness and elastic strain of the alloy are improved. Through silicon, alloy crystal grains are finer, steamed bun peaks are obviously coarsened, and the alloy directly fractures without yielding in a stretching process. Through simultaneous addition of zirconium and silicon, an integral melting point of the alloy is reduced, tensile strength is increased, and a color and luster degree is relatively good. Based on the total mass of the Cu-based microcrystal alloy and in terms of mass percentage, the Cu-based microcrystal alloy according to the disclosure includes 0 to 1.5 percent of zirconium (preferably 1.2 to 1.5 percent), and 0.05 to 2 percent of silicon (preferably 0.1 to 1.5 percent).

According to one preferable embodiment of the Cu-based microcrystal alloy according to the disclosure, based on the total mass of the Cu-based microcrystal alloy and in terms of mass percentage, the Cu-based microcrystal alloy includes the following elements:

| | |
|---|---|
| Mn | 20 to 30 percent, |
| Al | 0.01 to 10 percent, |
| Ni | 5 to 10 percent, |
| Ti | 1 to 1.5 percent, |
| Zr | 0 to 1.5 percent, |
| Si | 0.05 to 2 percent, and |
| | the balance of Cu. |

The Cu-based microcrystal alloy according to the disclosure may be prepared by various common methods. Particularly, raw materials of the Cu-based microcrystal alloy are sequentially molten and cast, wherein through the composition of the raw materials of the Cu-based microcrystal alloy, the obtained Cu-based microcrystal alloy is the Cu-based microcrystal alloy of the disclosure. Particularly, purity of the raw materials of the Cu-based microcrystal alloy is higher than 99.5 percent, preferably higher than 99.9 percent.

The disclosure is illustrated in details in combination with embodiments hereafter, but the scope of the disclosure is not limited thereto.

All samples in the following embodiments and contrast embodiments are subjected to a Vickers hardness test based on a digital Vickers hardness tester with a model being HVS-10Z according to GB/T 4340.4-2009.

A tensile performance (yielding strength, tensile strength and elastic strain) test is performed based on a microcomputer control electronic universal (tension) test machine with a model being CMT5105 according to GBT 222.8-2010.

In the following embodiments and contrast embodiments, the molten and cast Cu-based microcrystal alloy is subjected to die casting into molds of different structures. Obtained samples are subjected to visual inspection, and shaping performance is evaluated according to the following standards:

excellent: plump shape filling of materials, complete shaping in positions of complicated and tiny structures, and plump shape filling of cinder ladle openings;

good: plump shape filling of the materials, complete shaping in the positions of the complicated and tiny structures, and shrivelled shape filling of the cinder ladle openings;

general: complete shape filling of the materials, but unsuitable for tiny and complicated structure shaping;

poor: incomplete shaping of the materials;

shaping incapability: material fragmentation.

Embodiments 1-11 are used for illustrating the disclosure.

Embodiment 1

Calculation is respectively performed according to alloy composition in Table 1: Mn (with purity being 99.5 percent), Al (with purity being 99.9 percent), Ni (with purity being 99.95 percent), Ti (with purity being 99.9 percent), Zr (with purity being 99.97 percent), Si (with purity being 99.9 percent) and Cu (with purity being 99.95 percent) are weighed.

Alloy raw materials are put into a vacuum melting furnace. The vacuum melting furnace is subjected to vacuum pumping to a value below 5 Pa. Argon gas is introduced. A furnace body is preheated for 3 min at 25 kW, and is then heated to 1050 DEG C. at 50 kW. Casting is performed after heat insulation for about 5 min. Then, die casting is performed in a die casting machine at die casting temperature of 980 DEG C. The number of pressure turns is 2 Q. Heat insulation time is 5 s. A primary injection initial point is 150 mm, and a secondary injection initial point is 195 mm. Therefore, a die cast body of the Cu-based microcrystal alloy of the disclosure is obtained.

Hardness, yielding strength, tensile strength and elastic strain of the prepared Cu-based microcrystal alloy are tested, and results are listed in Table 2.

Embodiments 2-11

A die cast body of a Cu-based microcrystal alloy is prepared by a method identical to a method according to Embodiment 1. The difference is that raw materials of the Cu-based microcrystal alloy are prepared according to the composition in Table 1.

Hardness, yielding strength, tensile strength and elastic strain of the prepared Cu-based microcrystal alloy are tested, and results are listed in Table 2.

Contrast Embodiments 1-6

A die cast body of a Cu-based microcrystal alloy is prepared by a method identical to the method according to Embodiment 1. The difference is that raw materials of the Cu-based microcrystal alloy are prepared according to the composition in Table 1.

Hardness, yielding strength, tensile strength and elastic strain of the prepared Cu-based microcrystal alloy are tested, and results are listed in Table 2.

TABLE 1

Composition of Alloy Raw Materials in Embodiments 1-11 and Contrast Embodiments 1-6

| Serial Number of Embodiments | Mn | Al | Ni | Ti | Zr | Si |
|---|---|---|---|---|---|---|
| Embodiment 1 | 25 | 5 | 8 | 0.5 | 1.3 | 0.1 |
| Embodiment 2 | 23.5 | 8 | 9 | 0.8 | 1.5 | 0.8 |
| Embodiment 3 | 28 | 3.5 | 10 | 0.6 | 1.2 | 1.5 |
| Embodiment 4 | 25 | 5 | 8 | 0.3 | 1.3 | 0.1 |
| Embodiment 5 | 25 | 5 | 8 | 1.5 | 1.3 | 0.1 |
| Embodiment 6 | 23.5 | 8 | 9 | 0.8 | 0 | 0.8 |
| Embodiment 7 | 23.5 | 8 | 9 | 0.8 | 1 | 0.8 |
| Embodiment 8 | 28 | 3.5 | 10 | 0.6 | 1.2 | 0.05 |
| Embodiment 9 | 28 | 3.5 | 10 | 0.6 | 1.2 | 2 |
| Embodiment 10 | 29 | 0.01 | 10 | 0.8 | 1.5 | 0.8 |
| Embodiment 11 | 20.5 | 10 | 5 | 0.8 | 1.5 | 0.8 |
| Contrast Embodiment 1 | 25 | 11 | 10.3 | 0 | 0 | 0 |
| Contrast Embodiment 2 | 25 | 5 | 8 | 2 | 1.3 | 0.1 |
| Contrast Embodiment 3 | 25 | 5 | 8 | 0.5 | 2 | 0.1 |
| Contrast Embodiment 4 | 28 | 3.5 | 10 | 0.6 | 1.2 | 0 |
| Contrast Embodiment 5 | 28 | 3.5 | 10 | 0.6 | 1.2 | 0.01 |
| Contrast Embodiment 6 | 28 | 3.5 | 10 | 0.6 | 1.2 | 2.5 |

Note:

ratios in Table 1 are measured in percentage by mass, and additionally, the balance is Cu and unavoidable impurities.

TABLE 2

Performance of Cu-based Microcrystal Alloy Obtained in Embodiments 1-11 and Contrast Embodiments 1-6

| Serial Number of Embodiments | Hardness (HV) | Yielding strength (MPa) | Tensile strength (MPa) | Elastic strain (Percent) | Shaping performance |
|---|---|---|---|---|---|
| Embodiment 1 | 359 | — | 1000 | 1.9 | Excellent |
| Embodiment 2 | 344 | — | 945 | 0.95 | Excellent |
| Embodiment 3 | 350 | — | 982 | 0.9 | Excellent |
| Embodiment 4 | 263 | — | 800 | 0.8 | Good |
| Embodiment 5 | 290 | — | 820 | 0.95 | General |
| Embodiment 6 | 260 | — | 790 | 0.9 | Good |
| Embodiment 7 | 300 | — | 830 | 0.85 | Good |
| Embodiment 8 | 295 | — | 820 | 0.9 | Good |
| Embodiment 9 | 315 | — | 855 | 0.8 | Good |
| Embodiment 10 | 261 | — | 802 | 0.8 | Good |
| Embodiment 11 | 335 | — | 835 | 0.85 | Good |
| Contrast Embodiment 1 | 265 | 650 | 800 | 0.7 | Excellent |
| Contrast Embodiment 2 | 264 | 640 | 775 | 0.9 | Poor |
| Contrast Embodiment 3 | 253 | 610 | 762 | 1.2 | Poor |
| Contrast Embodiment 4 | 262 | 639 | 792 | 1 | Poor |
| Contrast Embodiment 5 | 288 | 659 | 815 | 0.9 | General |
| Contrast Embodiment 6 | 340 | — | 924 | 0.8 | Shaping incapability |

Note:

the sign "—" in Table 2 shows that the tested Cu-based microcrystal alloy does not have a yielding phenomenon.

Results of Table 2 show that the Cu-based microcrystal alloy according to the disclosure has good comprehensive mechanical performance, has no yielding phenomenon and has relatively high hardness, tensile strength and elastic strain under good shaping conditions.

Contrast Embodiment 1 is an existing Cu-based microcrystal alloy. Through comparing Embodiment 1 with Contrast Embodiment 1, it can be seen that the existing Cu-based microcrystal alloy has a yielding phenomenon, and has relatively low hardness, strength and elastic strain.

Through comparing Embodiment 1 with Contrast Embodiment 2, it can be seen that when content of titanium in the Cu-based microcrystal alloy is too high, the hardness and strength of a Cu-based microcrystal alloy material are reduced, and shaping performance becomes poor.

Through comparing Embodiment 1 with Contrast Embodiment 3, it can be seen that when content of zirconium in the Cu-based microcrystal alloy is too high, the Cu-based microcrystal alloy material is brittle. A crystallization phenomenon is serious. Yielding is generated. The shaping performance of the material is relatively poor.

Through comparing Embodiment 3 with Contrast Embodiment 4 and Contrast Embodiment 5, it can be seen that when no silicon exists in the Cu-based microcrystal alloy or content of silicon is too low, the hardness and tensile strength of the Cu-based microcrystal alloy are reduced. The material yielding occurs. Texture is soft. Deformation easily occurs.

Through comparing Embodiment 3 and with Contrast Embodiment 6, it can be seen that when the content of silicon in the Cu-based microcrystal alloy is too high, the hardness and tensile strength of the Cu-based microcrystal alloy are increased, but thermal shock resistance of the material becomes poor, and shaping cannot be realized.

The preferred embodiments of the present disclosure are described in detail above, but the present disclosure is not limited to the specific details in the above embodiments. Various simple variations may be made to the technical solutions of the present disclosure within the scope of the technical idea of the present disclosure, and such simple variations shall all fall within the protection scope of the present disclosure.

It should be further noted that the specific technical features described in the above specific embodiments may be combined in any suitable manner without contradiction. To avoid unnecessary repetition, various possible combinations are not further described in the present disclosure.

In addition, the various embodiments of the present disclosure may be combined without departing from the idea of the present disclosure, and such combinations shall also fall within the scope of the present disclosure.

In the descriptions of this specification, descriptions using reference terms "an embodiment", "some embodiments", "an example", "a specific example", or "some examples" mean that specific characteristics, structures, materials, or features described with reference to the embodiment or example are included in at least one embodiment or example of the present disclosure. In this specification, schematic descriptions of the foregoing terms do not necessarily directed at a same embodiment or example. In addition, the described specific features, structures, materials, or features can be combined in a proper manner in any one or more embodiments or examples. In addition, in a case that is not mutually contradictory, a person skilled in the art can combine or group different embodiments or examples that are described in this specification and features of the different embodiments or examples.

Although the embodiments of the present disclosure are shown and described above, it can be understood that, the foregoing embodiments are exemplary, and cannot be construed as a limitation to the present disclosure. Within the scope of the present disclosure, a person of ordinary skill in the art may make changes, modifications, replacements, and variations to the foregoing embodiments.

What is claimed is:

1. A Cu-based microcrystal alloy, comprising, based on a total mass of the Cu-based microcrystal alloy and in mass percentage:

20 to 30 percent of Mn,
0.01 to 10 percent of Al,
5 to 10 percent of Ni,
0.3 to 1.5 percent of Ti,
0 to 1.5 percent of Zr,
0.05 to 2 percent of Si, and
45 to 74.64 percent of Cu.

2. The Cu-based microcrystal alloy according to claim 1, wherein based on the total mass of the Cu-based microcrystal alloy and in mass percentage, the Cu-based microcrystal alloy comprises 0.5 to 0.8 percent of Ti.

3. The Cu-based microcrystal alloy according to claim 2, wherein based on the total mass of the Cu-based microcrystal alloy and in mass percentage, the Cu-based microcrystal alloy comprises 1.2 to 1.5 percent of Zr.

4. The Cu-based microcrystal alloy according to claim 3, wherein based on the total mass of the Cu-based microcrystal alloy and in mass percentage, the Cu-based microcrystal alloy comprises 0.1 to 1.5 percent of Si.

5. The Cu-based microcrystal alloy according to claim 4, wherein based on the total mass of the Cu-based microcrystal alloy and in mass percentage, the Cu-based microcrystal alloy comprises 23 to 28 percent of Mn.

6. The Cu-based microcrystal alloy according to claim 5, wherein based on the total mass of the Cu-based microcrystal alloy and in mass percentage, the Cu-based microcrystal alloy comprises 3 to 8 percent of Al.

7. The Cu-based microcrystal alloy according to claim 6, wherein based on the total mass of the Cu-based microcrystal alloy and in mass percentage, the Cu-based microcrystal alloy comprises 8 to 10 percent of Ni.

8. A method for preparing a Cu-based microcrystal alloy, comprising:

providing an alloy raw material including, based on a total mass of the Cu-based microcrystal alloy, 20 to 30 percent of Mn, 0.01 to 10 percent of Al, 5 to 10 percent of Ni, 0.3 to 1.5 percent of Ti, 0 to 1.5 percent of Zr, 0.05 to 2 percent of Si, and 45 to 74.64 percent of Cu;

melting the alloy raw material in a furnace into an alloy liquid; and casting the alloy liquid to obtain a die-cast body of the Cu-based microcrystal alloy.

9. The method according to claim 8, wherein the purity of the alloy raw materials of the Cu-based microcrystal alloy is higher than 99.5 percent.

10. The method according to claim 8, wherein based on the total mass of the Cu-based microcrystal alloy, the alloy raw material comprises 0.5 to 0.8 percent of Ti.

11. The method according to claim 8, wherein based on the total mass of the Cu-based microcrystal alloy, the alloy raw material comprises 1.2 to 1.5 percent of Zr.

12. The method according to claim 8, wherein based on the total mass of the Cu-based microcrystal alloy, the alloy raw material comprises 0.1 to 1.5 percent of Si.

13. The method according to claim 8, wherein based on the total mass of the Cu-based microcrystal alloy, the alloy raw material comprises 23 to 28 percent of Mn.

* * * * *